United States Patent [19]

Smith

[11] Patent Number: 4,569,517

[45] Date of Patent: Feb. 11, 1986

[54] PUSH-PULL SWING

[76] Inventor: Jack L. Smith, 10518 Ocean Dr., Baytown, Tex. 77520

[21] Appl. No.: 494,294

[22] Filed: May 13, 1983

[51] Int. Cl.[4] ..... A63G 9/16

[52] U.S. Cl. ..... 272/87; 272/67; 297/277

[58] Field of Search ..... 272/85, 86, 87, 88, 272/89, 90, 91, 92, 28 R; 297/452, 276, 277, 278, 279, 280; D21/246

[56] References Cited

U.S. PATENT DOCUMENTS

| | | | |
|---|---|---|---|
| 212,514 | 2/1879 | Ryan | 297/280 |
| 217,465 | 7/1879 | Lashorne | 272/90 |
| 281,216 | 7/1883 | White | D21/246 X |
| 743,546 | 11/1903 | Nix | 297/276 |
| 1,066,991 | 7/1913 | Brogley | 297/276 |
| 1,434,434 | 11/1922 | Eycleshymer | 272/89 |
| 1,603,052 | 10/1926 | Kolell | 272/92 |
| 1,839,579 | 1/1932 | Murray | 297/277 |
| 1,956,502 | 4/1934 | Galatowitsch | 272/85 UX |
| 2,092,993 | 9/1937 | Tinker | 272/87 |
| 2,491,875 | 12/1949 | Revelle et al. | 272/87 |
| 2,772,722 | 12/1956 | Paumen | 272/87 |
| 2,900,010 | 8/1959 | Oliver | 272/87 |

*Primary Examiner*—Robert A. Hafer
*Assistant Examiner*—Arnold W. Kramer
*Attorney, Agent, or Firm*—Neal J. Mosely

[57] ABSTRACT

A push-pull swing having a frame suspended from an elevated vertical support by a first pair of parallel ropes and a second pair of ropes spaced parallel to and vertically outward from the first pair. The frame comprises a vertical member having a plurality of vertically spaced horizontal openings to which is pivotally connected a horizontal member having a plurality of openings spaced inwardly from the outward end and at least one outermost vertical opening disposed near the outward end to receive the second pair of ropes which are secured to the horizontal member. A seat rest is removably and adjustably fastened to the horizontal member to adapt the swing to various sized persons and selectively control the amount of bending by the user to operate said swing. A vertically spaced apart upper and lower cross member extends outwardly equally from each side of the vertical member to receive the first pair of ropes which are secured to the lower cross member. A pair of back rest members are adjustably mounted adjacent the horizontal member on the second pair of ropes for vertical movement thereon for selectively supporting the back of the user.

4 Claims, 4 Drawing Figures

PUSH-PULL SWING

This invention relates to exercise and amusement devices, and more particularly to improvements and other species of a push-pull swing shown on Patent Application Ser. No. 06/460,741.

The principle object of this invention is to provide improvements to a push-pull swing for more exercise, comfort and adjustments.

Another object of this invention is to provide a push-pull swing, which is safe to use by persons who are disabled or for rehabilitation work.

Another object of this invention is to provide a push-pull swing in the shape of a horse, which will be more attractive to small children.

A further object of this invention is to provide a push-pull swing as a porch or family swing, which is safer and has more adjustments.

A still further object of this invention is to provide a push-pull swing with an additional seat for a small child to be entertained while the user is exercising.

An even further object of this invention is to provide a push-pull swing with less parts and less cost.

A still even further object of this invention is to provide a push-pull swing that will provide more exercise of all parts of the body than any other exerciser, with adjustments to control the amount of effort required for exercise, with the user having more enjoyment than any other exerciser. Be lower in cost than any other exerciser that will do as much, and that the whole family can enjoy.

These objects and other objects will be readily evident upon a study of the following specification, and the accompanying drawings wherein.

Figures 1, 2:
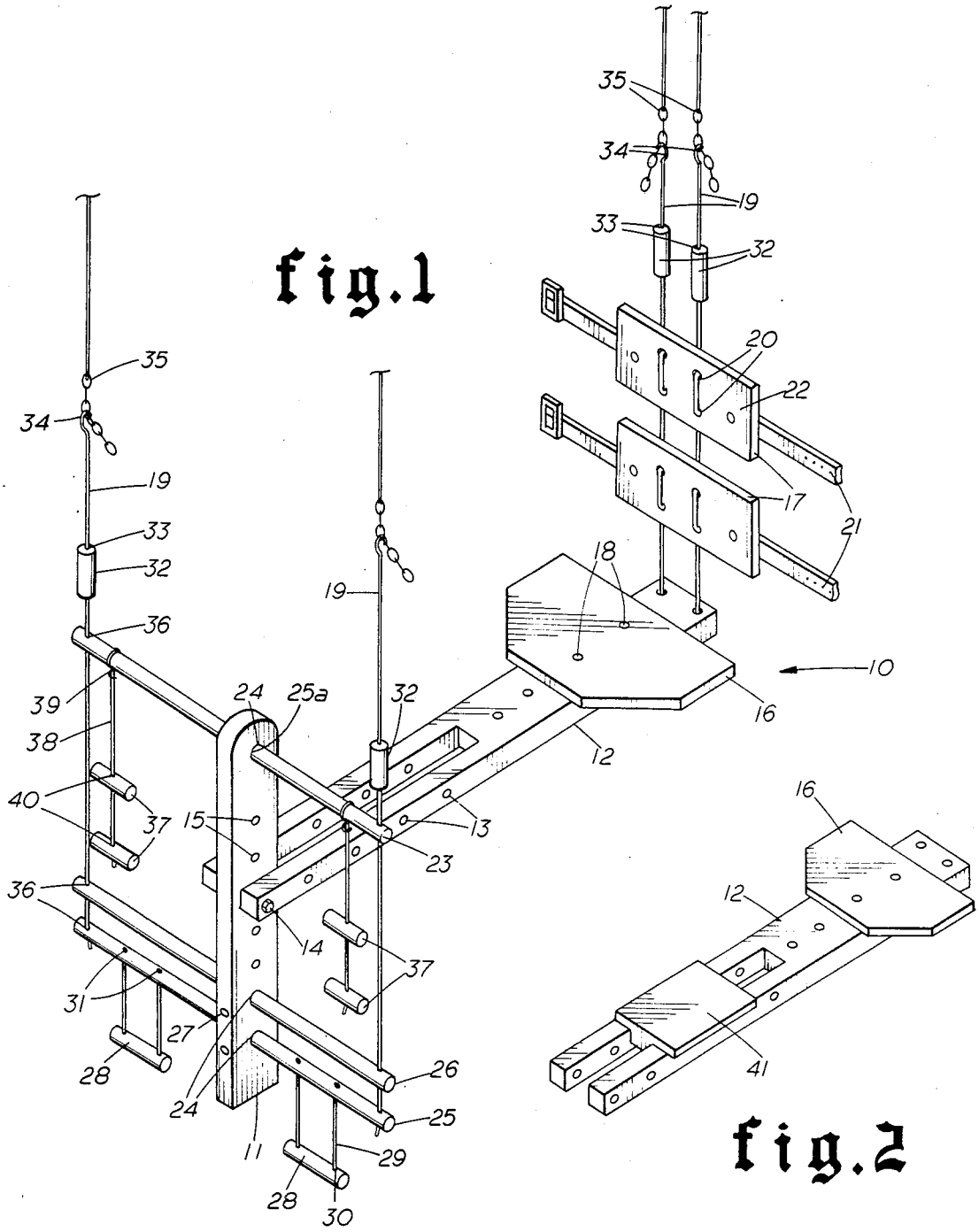
FIG. 1 is a perspective view of a push-pull swing for exercise.
FIG. 2 is a perspective view of a second seat for a push-pull swing for exercise.

Refering to FIG. 1, an improved push-pull swing 10 is shown to consist of a solid vertical frame 11, a grooved horizontal bar 12, which includes a plurality of spaced apart openings 13, to receive a removable pin 14, which is suitably fastened in one of a plurality of spaced apart openings 15, in frame 11. The placement thereof provides a means for adjustment of seat 16 and back rest 17 as a unit. The placement of pin 14 in one of a plurality of openings 15 in frame 11 provides for a vertical adjustment of horizonal bar 12 at its frame end.

Seat 16 is secured to horizonal bar 12 with suitable fasteners 18. A plurality of back rests 17 are secured to supporting ropes 19 at seat end of horizonal bar 12 being received in a plurality of openings 20 in back rests 17, wherein they are frictionally and adjustably held in place, providing a means of a vertical adjustment of back rests 17. It should be noted that a plurality of back rests 17 are used to better follow the users back for more comfort.

A plurality of straps 21 are fixedly secured to back rests 17 with suitable fasteners 22 as a means of providing safety straps for users of swing 10, who may be disabled or when swing 10 is used for rehabilitation work.

A rotatable handle bar 23 is secured in an opening 24 at top end of frame 11 with suitable fasteners **25*a* to allow handle bar 23 to turn, thereby providing a means for a twisting exercise for users hands, wrists, and arms. A plurality of foot rest bars 25 and 26 are fixedly secured in other openings 24 of frame 11 with suitable fasteners 27. It should be noted that a plurality of foot rest bars 25 and 26 are employed to provide a pulling exercise with users feet and for additional adjustment for the size of users of swing 10, and one foot rest bar 26** may not be used if so desired.

A plurality of adjustable foot rests 28 are adjustably secured to lower foot rest 25 as a means of providing an additional adjustment for users of swing 10 if so desired. Foot rests 28 are secured with ropes 29 in a plurality of openings 31 in lower foot rest bar 25. Ropes 29 are received in openings 30 of foot rests 28 and further received in openings 31 in foot rest bar 25 where they are knotted at their top ends to suit user.

A plurality of hand grips 32 are secured to supporting ropes 19 of swing 10 as a means of providing additional positions of hands for exercise. Supporting ropes 19 are received in openings 33 of handle grips 32 and are knotted below handle grips 32, thereby holding handle grips 32 adjustably in place. A S-hook 34 and chain 35 assembly provides an adjusting means for supporting ropes 19 and are placed in series with supporting ropes 19 as a means of providing a vertical adjustment of seat 16 for additional exercise and comfort, and a means to easily level and align swing 10. Swing 10 is supported by ropes 19, being received in openings 36 of handle bar 23, and foot rest bars 25, and 26 where they are knotted at their bottom ends and after passing thru handle bar 23. It should be noted that ropes 19 only need pass thru handle bar 23 if so desired for operation of swing 10.

A plurality of hand grips 37 are secured to various points of swing 10 with a rope 38 and hook 39 as a means of operating swing 10 and providing a means of additional exercise with arms in various positions. Ropes 38 are received in openings 40 of hand grips 37 and knotted at their bottom ends.

It should be noted at this time, that while not shown on drawings an additional horizonal bar 12, seat 16 back rests 17, hand grips 32 hand grips 37, ropes 19, and hook and chain 35 may be added to other side of frame 11 with another pin 14 in a different opening 15 of frame 11, or by slotting frame 11, or by making horizonal bar 12 wider.

Optionally, second seat 41 is secured to horizonal bar 12 as a means to provide a seat for a small child or a baby to be entertained while user of swing 10 is exercising.

In use swing 10 is secured to ceiling joists or other framework with ropes 19. It should be noted at this time if a single point mounting is desired a simple adapter may be employed.

The user then adjusts hook 34 in chain 35 in series with ropes 19 to level and align swing 10 and to raise or lower seat 16 as desired for exercise and/or comfort. The user than places pin 14 in one of the openings 13 of bar 12 to suit size of user, and one of the openings 15 in frame 11 for the desired effort for exercise. It should be noted at this time that openings 15 may be used as an adjustment for size of user such as for a small child. Raising bar 12 requires more effort with arms to operate swing 10, lowering bar 12 requires more effort for legs to operate swing 10. If foot rests 28 are required they are adjusted to suit user as required. The user then slides back rests 17 up or down to suit user for comfort.

The user then sits on seat 16 and secures safety straps 21 if required. The user then places feet on foot rests 25, 26, or 28 as desired. The user then places hands on rotatable handle bar 23, hand grips 32, or hand grips 37 as desired. If handle bar 23 is used, user may twist with wrists, pull with arms, or perform a curl type exercise. If hand grips 32 above frame 11 are used, the hands may be turned in, or turned out for exercise. If hand grips 32 over back rests 17 are used, these grips provide a hands over shoulder pulling exercise. If hand grips 37 are used, they can be placed at various points of swing 10, for an arms out to side pull exercise, or a pull up, or down exercise from front or back. The combination of exercises of hand grips is many as they are intended to be adjustable in rope 38 length. Hand grips 37 are easily changed from one point to another by the use of hook 39.

The user may use feet only to operate swing 10 if so desired. The user may use one foot or two, one foot may be placed on handle bar 23 and one foot on a foot rest if so desired for other exercises.

If user desires a pulling exercise with feet, the user places foot on foot rest bar 25 and hooks foot up against foot rest bar 26 as a means to hold foot in place. Adjustable foot rests 28 may be adjusted for this exercise also if desired.

If the user desires to entertain a small child or baby while exercising, seat 41 is placed on bar 12.

It should be noted also, that if additional effort is desired to operate swing 10 with hands, pressure may be applied with feet to one of the foot rests and vice versa for more effort for feet.

It should also be noted that this effect is similar to a isometric exercise.

Refering now to improvements of swing 10 in relation to existing push-pull swing. Frame 11 is one piece, having less parts. Handle bar 23 is rotatable, providing more exercise. A second back rest 17 is added for more comfort. Safty straps 21 are added, providing safety for a small child or disabled persons. Hand grips 32 and 37 are added for more and better exercise. Foot rest 26 is added for more exercise and adjustment for size of user. Adjustable foot rests 28 are added for additional adjustment for size of user. Hook 34 and chain 35 is added for additional exercise and comfort. A second seat 41 is added as a means for a second rider. Openings 13 are added to provide a means for adjustment of seat 16 and back rests 17 as a unit.

Figure 3:
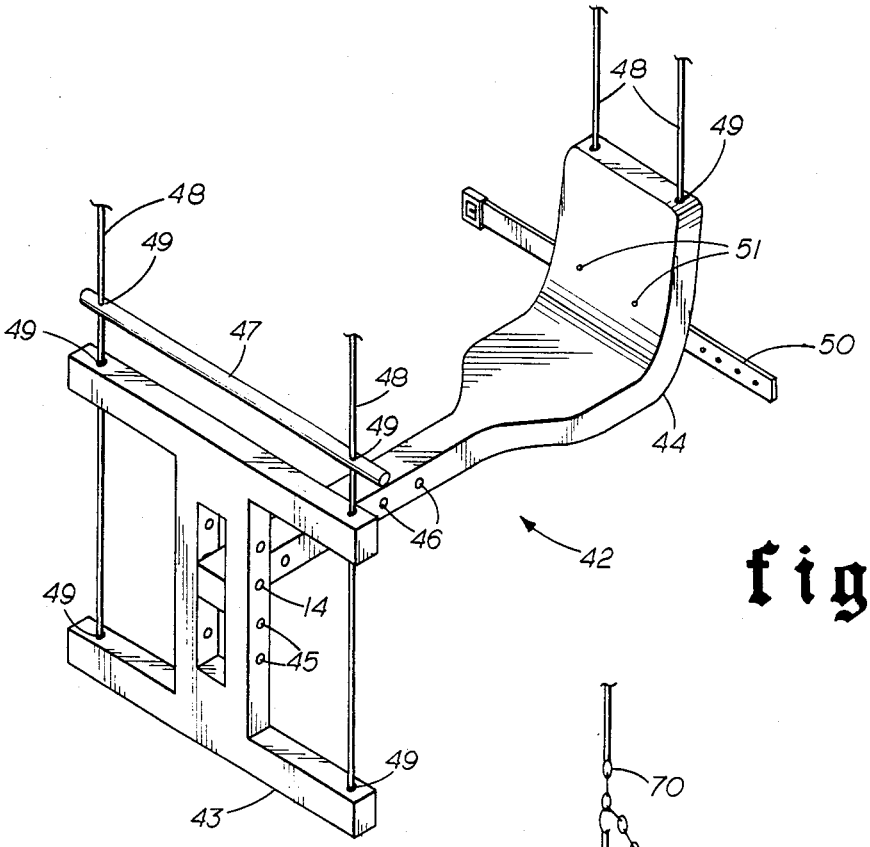
FIG. 3 is a perspective view of another species of a push pull swing having less parts.

Now refering to FIG. 3. Another version of a push-pull swing 42 having still less parts, consisting of a frame 43 which includes a handle bar and a foot rest as one piece. A seat rest 44 which includes a seat and a back rest as one piece. Frame 43 includes a plurality of openings 45, as a means for a vertical adjustment of seat rest 44 for exercise as shown for swing 10. Seat rest 44 includes a plurality of openings 46 as a means of adjustments for size of user as shown for swing 10. A pin 14 as shown in swing 10 is used to secure seat rest 44 to frame 43.

If a rotatable handle bar 47 is desired it is secured to ropes 48 in a plurality of openings 49, and ropes are knotted below handle bar 47. Handle bar 47 then serves the same purpose as handle bar 23 in swing 10. A strap 50 is secured to seat rest 44 with suitable fasteners 51. While not shown on drawing it is intended that hand grips 32, hand grips 37, foot rests 28, seat 41, and hook and chain 34 and 35 be secured to swing 42 in a similar manner as for swing 10, if so desired. Supporting ropes 48 are received in openings 49 of frame 43 and seat rest 44 to support swing 42.

Swing 42 operates in the same manner as swing 10 except for back rest which is not adjustable, and which item are added to swing 42.

Now refering to improvements of swing 42 to existing push-pull swing. Frame 43 has even less parts then swing 10, and seat rest 44 has less parts than existing push-pull swing.

Figure 4:
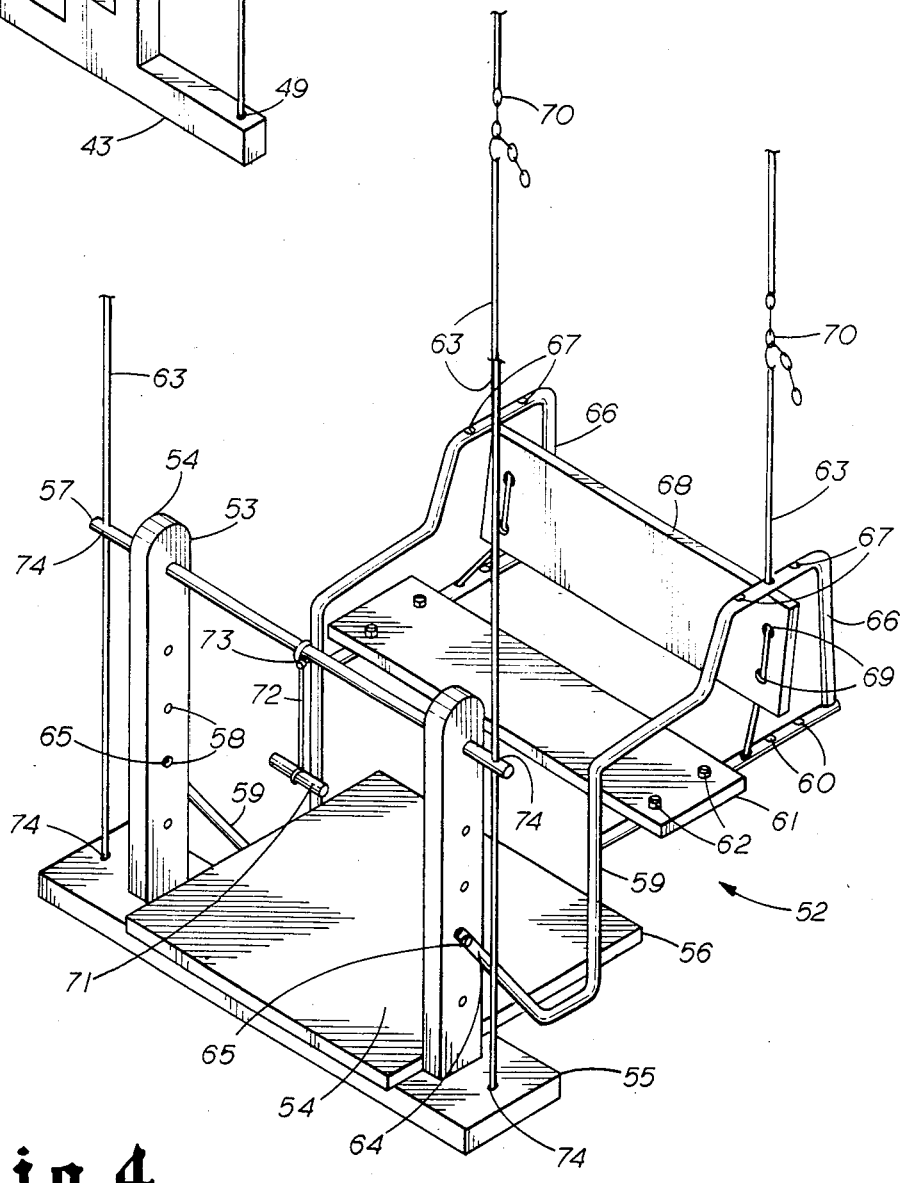
FIG. 4 is a perspective view of a porch or a family push-pull swing.

Refering now to FIG. 4 of drawing 2, a porch or family push-pull swing 52 is shown to consist of a frame 53, consisting of a pair of spaced apart vertical bars, a foot rest bar 55 fixedly secured to bottom of spaced apart vertical bars 54 with suitable fasteners, not shown. A foot rest platform 56 fixedly secured to foot rest bar 55 with suitable fasteners, not shown. A handle bar 57 secured to top end of spaced apart vertical bars 54, and a plurality of spaced apart and aligned openings 58 in vertical bars 54.

A pair of non-straight horizonal bars 59 with a plurality of spaced apart openings 60 for the horizonal adjustment of a seat 61 with suitable fasteners 62, and the attachment of supporting ropes 63, and a plurality of openings 64 to receive a removable pin 65, for the adjustable attachment of non-straight horizonal bars 59, to frame 53 in one of the openings 58 in vertical bars 54 of frame 53, thereby providing a means of vertical adjustment between platform 56, and seat 61, and a horizonal adjustment between seat 61, and frame 53.

It should be noted that the use of non-straight bars 59, are used to eliminate a tripping hazard of swing 52.

Arm rests 66 are secured to bars 59 in a suitable manner such as welding or similar means, arm rests 66 includes a plurality of spaced apart openings 67 to receive supporting ropes 63, as a means of providing an angular adjustment of back rests 68, by changing the opening 67 used in relation to the opening 60 used in bar 59 to receive ropes 63. Back rests 68 are secured to swing 52 in openings 69 in the same manner as for swing 10. The adjusting means 70 in series with ropes 63 is the same as swing 10 for changing seat 61 angle.

A hand grip 71, with a rope 72 and hook 73, is secured to handle bar 57 as shown for swing 10, as another means to operate swing 52.

Supporting ropes 63 are received in openings 74 in frame 53 to support frame 53 being knotted at their bottom ends.

In use swing 52 supporting ropes 63, are secured to a porch roof, or other framework with suitable fasteners. User then adjusts pin 65 in one of the openings 58 in frame 53, and one of the openings 64, in bar 59, to suit size of users. The user then adjusts seat 61, and back rest 68 angle for comfort, and also adjusts the adjusting means 70, for angle of seat 61, desired.

The user or users then sit on seat 61, and places feet on platform 56, and with push-pull movement of feet operates swing 52. If user desires to operate swing 52 with hands, handle bar 57, or hand grip 71, is used with a push-pull motion of hands.

It should be noted while not shown on drawing that a second pair of bars 59, a seat 61, a back rest 68, and adjusting means 70 may be added to other side of frame 53, for more riders if desired.

Now refering to improvements of swing 52 in relation to existing push-pull swing, non-straight horizonal bars 59 are used to eliminate a tripping hazard. Arm rests 66 are added for addional comfort, openings 60, and openings 67, are added as a means to change angle of back rest 68. Adjusting means 70 is added to adjust angle of seat 61, and hand grip 71 is added to operate swing 52, also a more secure foot rest bar 55 is shown.

While various changes may be made in the detail construction, it is understood that such changes will be within the spirit and scope of the present invention, including any and all framework, or adapters for use of a push-pull swing, as is defined by the appended claims.

What I now claim is:

1. A push-pull swing comprising in combination a frame having at least one vertically extending member having upper and lower horizontal cross members secured on the upper and lower ends thereof with outer end portions extending outward therefrom and having vertically extending apertures therein, said at least one vertically extending member having a plurality of vertically spaced horizontally extending and aligned openings therethrough, at least one horizontally extending member adapted to be adjustably and pivotally connected on said at least one vertical member and having a pair of spaced, vertically extending apertures at one end thereof, said horizontally extending member having pluralities of horizontally and longitudinally spaced apertures therein, said connection of said at least one horizontal member to said at least one vertically extending member comprising a pin passing through selected horizontal openings of said at least one vertical member and at least one horizontal member thereby providing a releasable and pivotal connection of said at least one horizontal member at a vertically and horizontally adjustable position with respect to said at least one vertical member, pairs of vertically extending ropes, a pair of which are secured one in each of said vertically extending apertures in the ends of said cross members and a pair of which are secured in the vertically extending apertures of said horizontally extending member, said ropes adapted to be secured to an elevated support, whereby said swing is supported by pairs of spaced vertical ropes facilitating horizontal movement thereof by the occupant pulling on said upper cross member end portions and pushing with the feet on said lower cross member, at least one seat rest adjustably positioned on said horizontally extending member by being secured in selected apertures therein, and at least one back rest member adjustably supported on a pair of said ropes adjacent to said seat for vertical positioning relative thereto, handgrip members vertically adjustably mounted on said ropes positioned to be gripped by the occupant whereby said horizontal movement of said swing can be facilitated by the occupant pulling or pushing on said handgrip members, at least one secondary handgrip member suspended from said upper horizontal cross member positioned to be gripped by the occupant to facilitate horizontal movement of said swing by pulling on said secondary handgrip member, and at least one secondary foot rest member suspended from said lower horizontal cross member.

2. A push-pull swing comprising in combination a frame having at least one vertically extending member having upper and lower horizontal cross members secured on the upper and lower ends thereof with outer end portions extending outward therefrom and having vertically extending apertures therein, said at least one vertically extending member having a plurality of vertically spaced horizontally extending and aligned openings therethrough, at least one horizontally extending member adapted to be adjustably and pivotally connected on said at least one vertical member and having a pair of spaced, vertically extending apertures at one end thereof, said horizontally extending member having pluralities of horizontally and longitudinally spaced apertures therein, said connection of said at least one horizontal member to said at least one vertically extending member comprising a pin passing through selected horizontal openings of said at least one vertical member and at least one horizontal member thereby providing a releasable and pivotal connection of said at least one horizontal member at a vertically and horizontally adjustable position with respect to said at least one vertical member, pairs of vertically extending ropes, a pair of which are secured one in each of said vertically extending apertures in the ends of said cross members and a pair of which are secured in the veritcally extending apertures of said horizontally extending member, said ropes adapted to be secured to an elevated support, whereby said swing is supported by pairs of spaced vertical ropes facilitating horizontal movement thereof by the occupant pulling on said upper cross member end portions and pushing with the feet on said lower cross member, at least one seat rest adjustably positioned on said horizontally extending member by being secured in selected apertures therein, and at least one back rest member member adjustably supported on a pair of said ropes adjacent to said seat for vertical positioning relative thereto, and handgrip members vertically adjustably mounted on said ropes positioned to be gripped by the occupant whereby said horizontal movement of said swing can be facilitated by the occupant pulling or pushing on said handgrip members.

3. A push-pull swing comprising in combination a frame having at least one vertically extending member having upper and lower horizontal cross members secured on the upper and lower ends thereof with outer end portions extending outward therefrom and having vertically extending apertures therein, said at least one vertically extending member having a plurality of vertically spaced horizontally extending and aligned openings therethrough, at least one horizontally extending member adapted to be adjustably and pivotally connected on said at least one vertical member and having a pair of spaced, vertically extending apertures at one end thereof, said horizontally extending member having pluralities of horizontally and longitudinally spaced apertures therein, said connection of said at least one horizontal member to said at least one vertically extending member comprising a pin passing through selected horizontal openings of said at least one vertical member and at least one horizontal member thereby providing a releasable and pivotal connection of said at least one horizontal member at a vertically and horizontally adjustable position with respect to said at least one vertical member, pairs of vertically extending ropes, a pair of which are secured one in each of said vertically extending apertures in the ends of said cross members and a pair of which are secured in the vertically extending apertures of said horizontally extending member, said ropes adapted to be secured to an elevated support, whereby said swing is supported by pairs of spaced vertical ropes facilitating horizontal movement thereof by the occupant pulling on said upper cross member end portions and pushing with the feet on said lower cross member, at least one seat rest adjustably positioned on said horizontally extending member by being secured in selected apertures therein, and at least one back rest member member adjustably supported on a pair of said ropes adjacent to said seat for vertical positioning relative thereto, and safety means for securing an occupant to said back rest to prevent falling from said apparatus.

4. A push-pull swing comprising in combination a frame having at least one vertically extending member having upper and lower horizontal cross members secured on the upper and lower ends thereof with outer end portions extending outward therefrom and having vertically extending apertures therein, said upper cross member being rotatably secured in said said at least one vertically extending member to permit twisting movement by the hands of the occupant, said at least one vertically extending member having a plurality of vertically spaced horizontally extending and aligned openings therethrough, at least one horizontally extending member adapted to be adjustably and pivotally connected on said at least one vertical member and having a pair of spaced, vertically extending apertures at one end thereof, said horizontally extending member having pluralities of horizontally and longitudinally spaced apertures therein, said connection of said at least one horizontal member to said at least one vertically extending member comprising a pin passing through selected horizontal openings of said at least one vertical member and at least one horizontal member thereby providing a releasable and pivotal connection of said at least one horizontal member at a vertically and horizontally adjustable position with respect to said at least one vertical member, pairs of vertically extending ropes, a pair of which are secured one in each of said vertically extending apertures in the ends of said cross members and a pair of which are secured in the vertically extending apertures of said horizontally extending member, said ropes adapted to be secured to an elevated support, whereby said swing is supported by pairs of spaced vertical ropes facilitating horizontal movement thereof by the occupant pulling on said upper cross member end portions and pushing with the feet on said lower cross member, at least one seat rest adjustably positioned on said horizontally extending member by being secured in selected apertures therein, and at least one back rest member member adjustably supported on a pair of said ropes adjacent to said seat for vertical positioning relative thereto.

* * * * *